United States Patent [19]

Feinberg

[11] Patent Number: 4,939,995

[45] Date of Patent: Jul. 10, 1990

[54] INTEGRATOR AND FIRING CIRCUIT FOR PROXIMITY FUZES

[75] Inventor: Arthur R. Feinberg, Brookeville, Md.

[73] Assignee: The United States of America as represented by the Secretary of the Navy, D.C.

[21] Appl. No.: 523,785

[22] Filed: Nov. 11, 1974

[51] Int. Cl.[5] ..... F42C 13/04

[52] U.S. Cl. ..... 102/214; 102/213; 307/283

[58] Field of Search ..... 102/70.2 R, 70.2 P, 102/213, 214; 343/7 PF; 307/283-285, 293, 294, 301, 597-599, 107-108

[56] References Cited

U.S. PATENT DOCUMENTS

| | | | |
|---|---|---|---|
| 3,032,714 | 5/1962 | Cohen | 307/597 |
| 3,249,771 | 5/1966 | Pearse et al. | 307/591 |
| 3,331,967 | 7/1967 | Moore | 307/595 |
| 3,439,616 | 4/1969 | Godsey et al. | 102/70.2 R |
| 3,483,401 | 12/1969 | Michalski | 307/598 |
| 3,895,580 | 7/1975 | Tedder | 102/70.2 P |

*Primary Examiner*—Charles T. Jordan
*Assistant Examiner*—Stephen Johnson
*Attorney, Agent, or Firm*—Kenneth E. Walden

[57] ABSTRACT

A projectile proximity fuze firing circuit which is compatible with the requirements of both a negative supply voltage and a grounded electronic detonator. In addition, a simple and novel transistor full wave rectifier and integrator is disclosed.

4 Claims, 2 Drawing Sheets

INTEGRATOR AND FIRING CIRCUIT FOR PROXIMITY FUZES

BACKGROUND OF THE INVENTION

The present invention relates generally to fuze circuits and more particularly to firing circuits for fuzes.

Safety considerations in the design of fuze circuits has already been of prime importance. False firings of projectiles and bombs due to improperly designed fuzes can cause extensive damage to property and life. Safety precautions, such as grounding the electronic circuit of the fuze to the weapon's casing and driving the fuze circuit with a negative supply, have virtually eliminated false firings due to the outside electromagnetic energy interference. However, such precautions have resulted in the necessity of entirely new fuze circuitry operable from a negative supply. For example, standard capacitive discharge circuitry is inoperable from a negative supply when the load is grounded.

In addition, due to the limited space available in the weapon, fuze design has required a minimum number of components to carry out designed functions necessary to the operation of the fuze. For example, standard fullwave rectifiers and integrators contain too many electrical components and are too bulky for fuze design.

SUMMARY OF THE INVENTION

The present invention overcomes the disadvantages and limitations of the prior art by providing an improved integrator and firing circuit for fuzes.

The present invention utilizes a transistor as a unity gain inverter for negative doppler signal excursions from the detector portion of the fuze and is switched to saturation mode for positive excursions. The waveform at the collector thus closely approximate a fullwave rectification of the input doppler signal from the detector of the fuze. This eliminates the use of a standard, bulky diode bridge for a single transistor. A programmable unijunction transistor (PUT) is used in conjunction with voltage dividing resistors to cause a pulse when the threshold level is exceeded to fire a silicon controlled rectifier (SCR). The SCR is connected to a novel capacitive discharge circuit used to fire the squib.

It is therefore the object of the present invention to provide an improved firing circuit for a fuze.

It is also an object of the present invention to provide a firing circuit which is inexpensive and expendable.

Another object of the present invention is to provide a firing circuit which is small and compact.

Other objects, advantages and novel features of the invention will become apparent from the following detailed description of the invention when considered in conjuction with the accompanying drawings wherein:

DETAILED DESCRIPTION OF THE PREFERRED EMBODIMENTS

Figure 1:
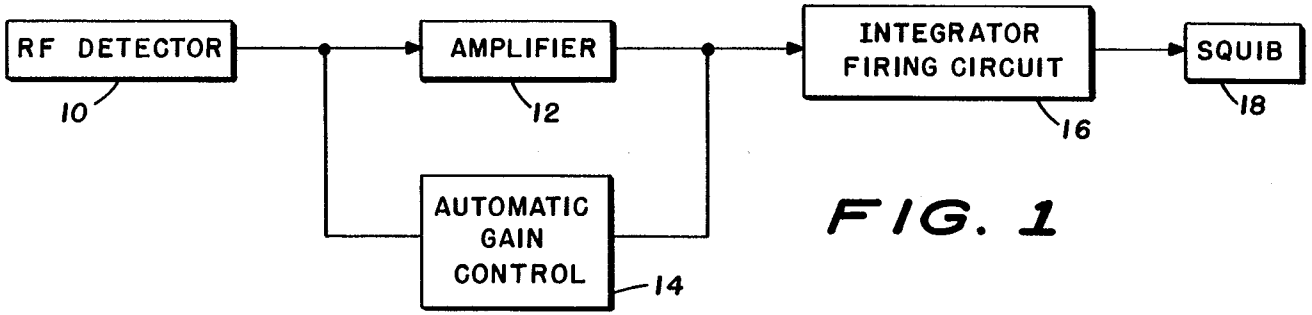
FIG. 1 is a block diagram of the entire fuze circuit.
Figure 3A:
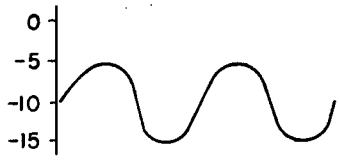
FIG. 3A to 3F disclose waveforms at particular locations in the circuit of FIG. 2.

FIG. 1 discloses the overall fuze circuit in block diagram form. The fuze detector 10 detects a signal indicating a target. The amplifier 12 and automatic gain control 14 amplify and filter the signal presented to the integrator firing circuit 16 so that it presents a sinusoidally shaped signal as shown in FIG. 3A of the detected doppler wave sensed by RF detector 10. The integrator firing circuit 16, comprising the present invention, produces a firing pulse to fire the squib 18 when its input sinusoidal signal exceeds a threshold level indicating the presence of a target.

Figure 2:
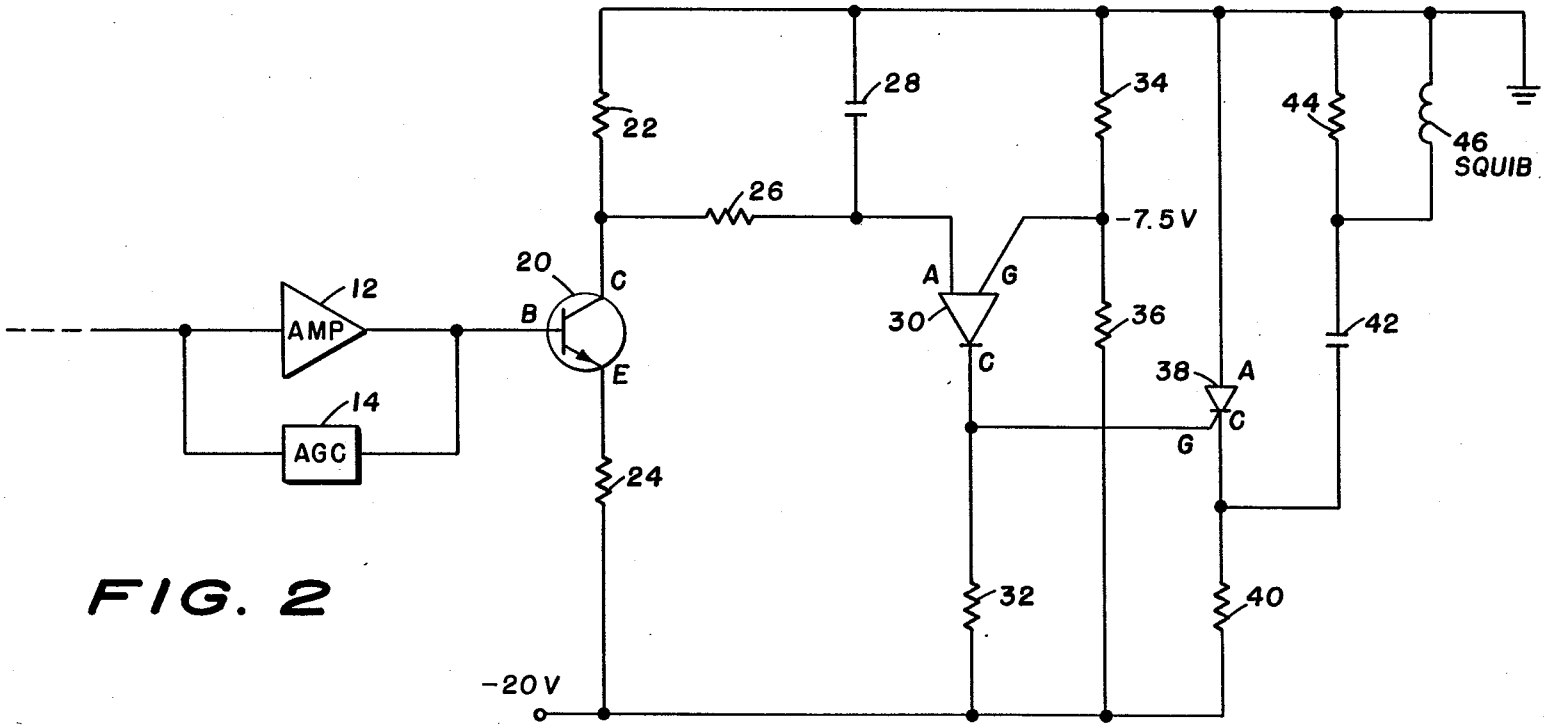
FIG. 2 is a diagram of the integrator and firing circuit comprising the preferred embodiment of the present invention.
Figure 3B:
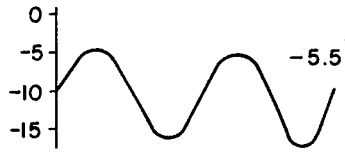
Figure 3C:
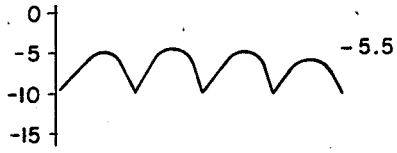

FIG. 2 discloses the circuitry comprising the preferred embodiment of the present invention disclosed in FIG. 1 as element 16. The waveform of FIG. 3A is applied to the base of transistor 20. The emitter lead follows that waveform as shown in FIG. 3B. However the output at the collector of transistor 20 closely approximates a fullwave rectification from the doppler output of amplifier 12 as shown in FIG. 3C. Transistor 20 thus behaves as a unity gain inverter to negative input signal excursions and is switched to a saturation mode for positive input signal excursions.

Figure 3D:
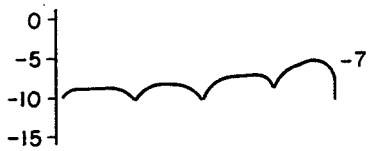
Figure 3E:
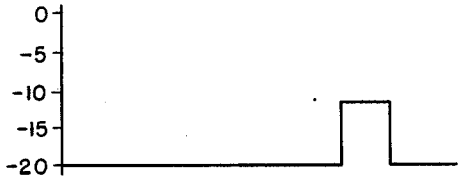
Figure 3F:
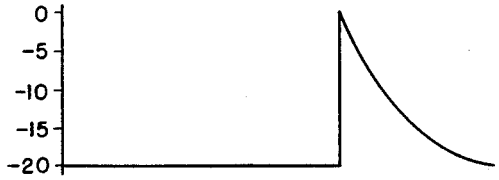

Resistor 26 and capacitor 28 act as an inverter of the full wave rectifier signal shown in FIG. 3C. This rectified signal causes a more positive charge to build up on integrating capacitor 28 as shown in FIG. 3D which is biased at −10 volts until the input to the anode of the programmable unijunction transistor (PUT) 30 exceeds the voltage input at the gate of the PUT 30 at which time the PUT is switched "on" causing a pulse to be applied to the gate of SCR 38 as shown in FIG. 3E. Resistors 34 and 36 set the threshold level of the gate of PUT 30.

The SCR 38 is used to discharge the firing capacitor 42 of the capacitive discharge firing circuit constituting elements 40, 42, and 44. Resistors 40 and 44 act as charging resistors for firing capacitor 42. The pulse applied to the gate of SCR 38 causes it to conduct and form a path to ground potential to discharge the firing capacitor 42 rapidly thereby forming a pulse which fires the squib 46.

For safety purposes the squib is grounded. This novel configuration of the capacitive discharge circuit which was developed for this system is therefore necessary since the SCR 38 could only be connected through the negative supply voltage via the high impedance charging resistor 40. No other configuration of the firing circuit allows operation with a negative supply voltage and a squib with one terminal grounded to insure safety.

Obviously many modifications variations of the present invention are possible in light of above teachings. It is therefore to be understood that wi the scope of the appended claims the invention may be practiced otherwise than as specifically described.

What is claimed as new and desired to be secured by Letters Patent of the U.S. is:

1. An integrator firing circuit for use with a fuze for firing a grounded squib of an explosive weapon comprising:

a transistor biased to transform a negatively biased varying electrical signal to a fullwave rectified negatively biased signal at its collector lead;

means for integrating said fullwave rectified signal;

first switching means connected to said means for integrating for producing a first pulse upon detection of a signal from said means for integrating which exceeds a predetermined threshold level and, capacitive discharge means connected to said first switching means for producing a second pulse to ignite said grounded squib of said explosive weapon.

2. The integrator firing circuit of claim 1 wherein said capacitive discharge means comprises:

a SCR having a grounded anode, a gate connected to said first switching means and a cathode;

a first charging resistor having first and second leads wherein said first lead is grounded;

a firing capacitor connected between said second lead of said first charging resistor and said cathode of said SCR;

a second charging resistor connected between said cathode of said SCR and a negative voltage supply.

3. The integrator firing circuit of claim 1 wherein said first switching means comprises a programmable unijunction transistor.

4. The integrator firing circuit of claim 2 wherein said first switching means comprises a programmable unijunction transistor.

* * * * *